US005571283A

United States Patent [19]

Vollgold

[11] Patent Number: 5,571,283

[45] Date of Patent: Nov. 5, 1996

[54] SHAKING AND MIXING DEVICE WITH A BLOWER

[75] Inventor: Günter Vollgold, Rednitzhembach, Germany

[73] Assignee: Heidolph-Elektro GmbH & Co. KG, Kelheim, Germany

[21] Appl. No.: 302,643

[22] PCT Filed: Dec. 9, 1993

[86] PCT No.: PCT/EP93/03467

§ 371 Date: Nov. 8, 1994

§ 102(e) Date: Nov. 8, 1994

[87] PCT Pub. No.: WO94/15705

PCT Pub. Date: Jul. 21, 1994

[30] Foreign Application Priority Data

Jan. 14, 1993 [DE] Germany ..... 43 00 748.1

[51] Int. Cl.[6] ..... B01F 11/00; B01F 15/06

[52] U.S. Cl. ..... 366/143; 366/147; 366/208

[58] Field of Search ..... 366/108, 110–114, 366/143, 144, 146, 147, 208–217, 219

[56] References Cited

U.S. PATENT DOCUMENTS 3,002,895 10/1961 Freedman .
4,054,151 10/1977 Parker et al. .
4,061,315 12/1977 Eitzen et al. ..... 366/208 X
4,673,297 6/1987 Siczek et al. ..... 366/208
4,747,693 5/1988 Kahl ..... 366/208
5,052,812 10/1991 Tannenbaum et al. ..... 366/209

FOREIGN PATENT DOCUMENTS 2120435 11/1972 Germany .
2810678 9/1978 Germany .

*Primary Examiner*—Charles E. Cooley
*Attorney, Agent, or Firm*—Collard & Roe, P.C.

[57] ABSTRACT

A vibrating mixer has a housing for electric switching and regulating members and an electric motor, a motor-drivable tray-shaped bearing surface for containers which receive the materials to be vibrated and mixed, a hood which encloses the housing and the bearing surface together with the container, as well as a cold and/or warm air blower which opens inside the hood. In order to reduce the weight of the hood and to allow the unimpeded observation of the vibrated materials, the housing for the electric motor and the housing for the blower are arranged immediately next to each other in a fixed or detachable manner, and both housings are simultaneously covered by a single hood which may be freely set on both housings.

8 Claims, 2 Drawing Sheets

SHAKING AND MIXING DEVICE WITH A BLOWER

BACKGROUND OF THE INVENTION

1. Field of the Invention

The present invention relates to a shaking and mixing device with a housing for accommodating electric switching and controlling elements and an electric motor, a plate-shaped bearing surface for the container receiving the material to be shaken and mixed, said surface being drivable by the electric motor, a hood gripping over the housing and the bearing surface with the containers, as well as with a blower for cold and/or warm air feeding into the interior space of the hood.

2. The Prior Art

It is known already to place shaking and mixing devices in a hood, on the top side of which there is arranged a warm/cold air blower blowing into the interior space of the hood via openings. Furthermore, it is known in connection with a shaking and mixing device to set up the hood on the housing receiving the drive for the bearing surface, and to rigidly arrange a warm/cold air blower on the hood on the outside on top, such blower feeding air into the interior space of the hood. These shaking and mixing devices have the drawback in common that the hoods acting in each case as the support for the blowers have to be designed with thick walls for stability reasons, and thus weighty, so that such hoods can be handled only with expenditure of force and in a complicated way. Moreover, the blowers impair the sight into the interior space of the hoods.

SUMMARY OF THE INVENTION

It is an object of the present invention to create in connection with shaking and mixing devices, measures for the use of hoods with a low weight and unobstructed possibilities for viewing the vibrating material.

According to the invention, this object is achieved by having the housing receiving the electric motor and the housing of the blower being arranged directly fixed or detachably fixed next to each other, and that the two housings are jointly overgripped at the same time by one single hood, which can be freely set up on the two housings.

According to a preferred embodiment, provision is made that the housing receiving the drive for the bearing surface and the blower housing have top sides extending in one common plane; that the top sides of both housings support a plate-like support made of a flexible material, e.g. rubber; and that the hood can be set up at least approximately tightly on the plate. In this way, the hood can be embodied with thin walls and a low weight and thus handled simply and safely. Furthermore, the shaking stations can be easily inspected, and they are accessible without obstructions for the feeding or removal of the shaken material, or of the containers. Finally, owing to the fact that the blower remains on or next to the housing for the bearing surface, hoods with different heights and shapes are usable selectively. Moreover, the weight of the hood and the blower is supported via the two housings directly on the set-up furniture, and not on the mixing and shaking device.

In designing the shaking and mixing device, the hood can be formed by at least two hood segments placeable one on top of the other or next to each other, which means that the hood has to be removed partially, if need be, for feeding or removing shaking material or containers.

Usefully, the hood is formed by two hood segments separated within the zone of a transverse plane, of which one segment has a groove, fold or the like in the marginal zone limiting the plane of separation, such groove, fold or the like extending all around, and the other hood segment, in its marginal zone limiting the plane of separation, engages the groove, fold or the like for guiding and supporting the two hood segments. It is preferred in this connection that the hood segments are designed with different heights, whereby the hood segment closer to the bearing surface has a lower height. It is understood that hood segments of any desired height or shape can be set up on the hood segment closer to the bearing surface. Furthermore, provision is made that the blower housing is provided with an outlet duct for the blower air, such duct being sloped in the direction of and across the bearing surface upwardly, whereby in a manner saving space, the outlet duct is divided into sections for feed air and exhaust air. The blower can be selectively designed as a circulating air and/or feed air blower, whereby provision can be made for possibilities for switching from circulating to feed air. A directed air feed in the hood can be finally obtained by arranging guiding lamellae for the blower air in the outlet duct, preferably at the outlet end of the latter.

BRIEF DESCRIPTION OF THE DRAWINGS

Other objects and features of the present invention will become apparent from the following detailed description considered in connection with the accompanying drawing which discloses two embodiments of the present invention. It should be understood, however, that the drawing is designed for the purpose of illustration only and not as a definition of the limits of the invention.

The invention is explained on the basis of an exemplified embodiment shown in the drawing, in which.

DETAILED DESCRIPTION OF PREFERRED EMBODIMENTS

Figure 1:
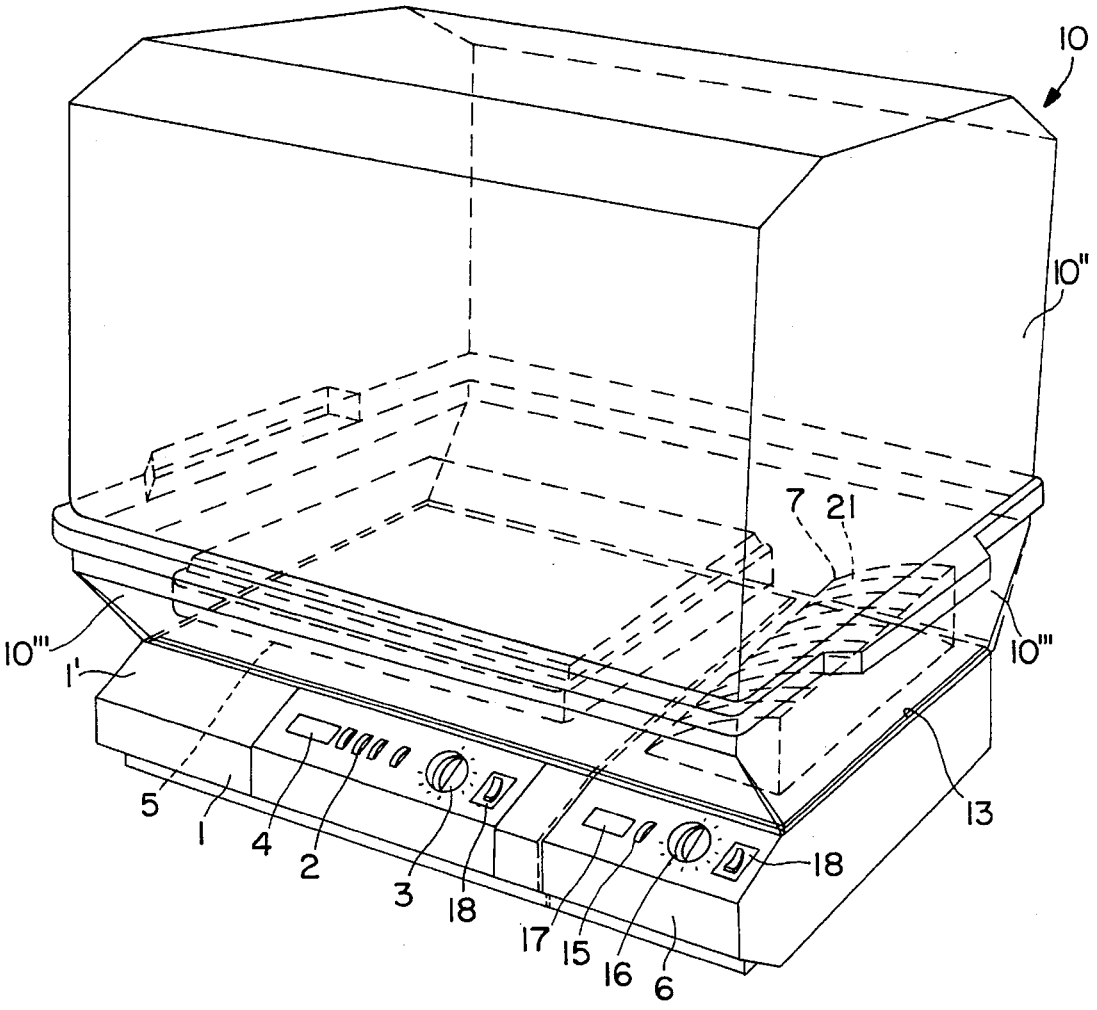
FIG. 1 shows a perspective view of a mixing and shaking device.
Figure 2:
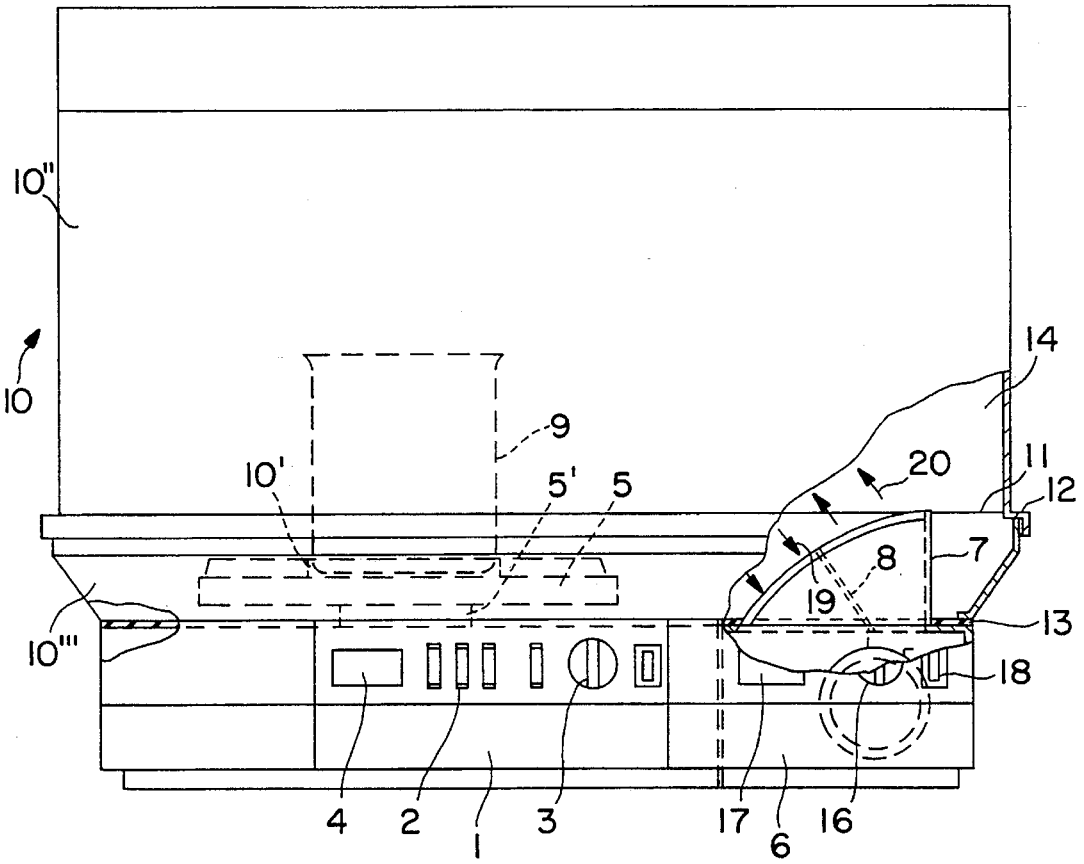
FIG. 2 shows a front view of a mixing and shaking device, partly in a sectional view.

Turning now in detail to the drawings, FIG. 1 denotes a housing, which has the switching and controlling elements 2, 3, and an indication 4 for a drive with an electric motor (not shown) for a bearing surface 5, said drive being accommodated in the housing 1 At its front side 1', the housing 1 has the shape of a lectern. A housing 6 receiving a blower is set up next to the housing 1. The blower housing 6 can be rigidly connected with the housing 1, or freely set up against the latter. The blower housing 6, at its top side above a passage opening, has an outlet duct 7 for the blower air, in which duct the guiding lamellae 21 are formed. The outlet duct 7 receives a separating wall 8 for the exhaust air 20 and the feed air 19 of the air currents of the blower. The guiding lamellae for the blower air are formed fixedly or adjustably in section in the outlet duct.

A plate-like support 13 made of a flexible material, e.g. rubber, is placed on the two housings 1 and 6, said support having recesses for the passage of the outlet duct 7 and of the driving member 5' for the bearing surface 5. Reference numeral 9 denotes a shaking container, which is placed in a deepening 5" in the bearing surface 5.

A hood 10 preferably made of a transparent material, e.g. plastic, is set up on the two housings 1 and 6; in the exemplified embodiment, this hood is formed by the hood segments 10' and 10". The two hood segments 10' and 10" are designed with different heights, and the hood segment 10", within the zone of the separation plane 11, is provided with a fold 12, which facilitates and safely permits the aligned support of the two hood segments 10' and 10" one on top of the other. It is understood that the hood segments 10' and 10" can have any desired shape, and also different or the same heights. The hood segment 10' with its lower marginal zone 10'" is set up on the support 13, which effects a sealing of the interior space 14 of the hood against the outside air.

If an electric heating register is arranged in the blower housing 6, it is possible to adjust in the feed air 19 or exhaust air 20 a predetermined temperature, e.g. 37°, which can be influenced by the switching and controlling elements 15, 16, and read on an indication 17. Reference numeral 18 denotes on/off-switches.

I claim:

1. Shaking and mixing device comprising a device housing having a drivable plate-like bearing surface;

a blower for cold air and warm air, and a blower housing for receiving the blower;

said device housing and said blower housing are arranged directly next to each other fixed or detachably fixed together; and a common covering hood for overgripping the device housing and the blower housing jointly at the same time, and said covering hood can be freely mounted on the two housings; the blower feeding the air into an interior space defined within the common covering hood.

2. Shaking and mixing device according to claim 1, wherein said device housing and said blower housing each have a top side and said top sides extending in a common plane;

on said top sides of the two housings a plate-like support made of flexible material is mounted; and said plate-like support being provided with recesses for passage of an air stream and serving as a sealing body;

a driving member positioned on said plate-like support; and the covering hood being mounted at least nearly tight on the plate-like support.

3. Shaking and mixing device according to claim 1, wherein said covering hood comprises at least two covering hood segments which are mounted one above the other.

4. Shaking and mixing device according to claim 3, wherein said at least two covering hood segments are separated in the area of a transverse plane;

one of said at least two covering hood segments having a groove extending all around the rim of a separating plane; and the other of said at least two covering hood segments having a rim area and engaging said groove with the rim area limiting the separation plane for guiding and supporting the at least two hood segments on top of each other.

5. Shaking and mixing device according to claim 1, wherein the blower housing has an outlet duct air channel directed slopingly across the bearing surface and directed upwardly, and that the outlet duct has one section for blower feed air and another section for blower exhaust air.

6. Shaking and mixing device according to claim 5, wherein guiding lamellae for the blower air are formed fixedly or adjustably in the blower feed air section of the outlet duct.

7. Shaking and mixing device according to claim 5, wherein the blower comprises a circulation air blower.

8. Shaking and mixing device according to claim 5, wherein the blower comprises a feed air blower.

* * * * *